US011812852B2

(12) United States Patent
Koch

(10) Patent No.: US 11,812,852 B2
(45) Date of Patent: Nov. 14, 2023

(54) ACTUATOR SYSTEM AND MULTIFUNCTIONAL TABLE COMPRISING SUCH AN ACTUATOR SYSTEM

(71) Applicant: Anna Mária Koch, Budapest (HU)

(72) Inventor: Anna Mária Koch, Budapest (HU)

( * ) Notice: Subject to any disclaimer, the term of this patent is extended or adjusted under 35 U.S.C. 154(b) by 13 days.

(21) Appl. No.: 17/635,433

(22) PCT Filed: Aug. 6, 2020

(86) PCT No.: PCT/HU2020/050037
§ 371 (c)(1),
(2) Date: Feb. 15, 2022

(87) PCT Pub. No.: WO2021/028704
PCT Pub. Date: Feb. 18, 2021

(65) Prior Publication Data

US 2022/0304462 A1 Sep. 29, 2022

(30) Foreign Application Priority Data

Aug. 15, 2019 (HU) ..... 1900293

(51) Int. Cl.
*A47B 9/10* (2006.01)
*A47B 9/04* (2006.01)
*A47B 27/16* (2006.01)

(52) U.S. Cl.
CPC ..... *A47B 9/10* (2013.01); *A47B 9/04* (2013.01); *A47B 27/16* (2013.01); *A47B 2200/008* (2013.01); *A47B 2200/0056* (2013.01)

(58) Field of Classification Search
CPC .... A47B 9/10; A47B 9/20; A47B 9/04; A47B 27/16; A47B 2200/0056; A47B 2200/008
See application file for complete search history.

(56) References Cited

U.S. PATENT DOCUMENTS 7,270,062 B1 * 9/2007 Larson ..... A47B 9/10 108/150
10,561,233 B1 * 2/2020 Lin ..... A47B 9/12
(Continued)

FOREIGN PATENT DOCUMENTS

DE 10321319 A1 * 12/2004 ..... A47B 9/10

*Primary Examiner* — Daniel J Rohrhoff
(74) *Attorney, Agent, or Firm* — Olson & Cepuritis, Ltd.

(57) ABSTRACT

The invention relates to an actuator system (100) for a table (200) having at least two table legs (210) of variable length and a table top (220) held by the table legs (210), characterized in that it comprises at least two master cylinders (10), each having a cylinder (10*a*) and a piston (10*b*) movable in the cylinder (10*a*) and a piston rod (10*c*) for moving the piston (10*b*), wherein a slave cylinder (20) having a cylinder (20*a*) and a piston (20*b*) movable in the cylinder (20*a*) for changing the length of the table leg (210) is connected to each of the master cylinders (10) by means of a conduit (40) allowing fluid (30) flow between the master cylinder (10) and the slave cylinder (20), and wherein the piston rods (10*c*) of the master cylinders (10) are mechanically connected to each other by means of a rigid connecting element (45), and wherein a drive unit (52) in a rigid drive connection (50) with the connecting element (45) is connected to the connecting element (45) for simultaneously moving the pistons (10*a*) of the master cylinders (10). The invention further relates to a multifunctional table (200) comprising an actuator system (100) according to the invention.

20 Claims, 11 Drawing Sheets

(56) References Cited

U.S. PATENT DOCUMENTS

Figure 1A:
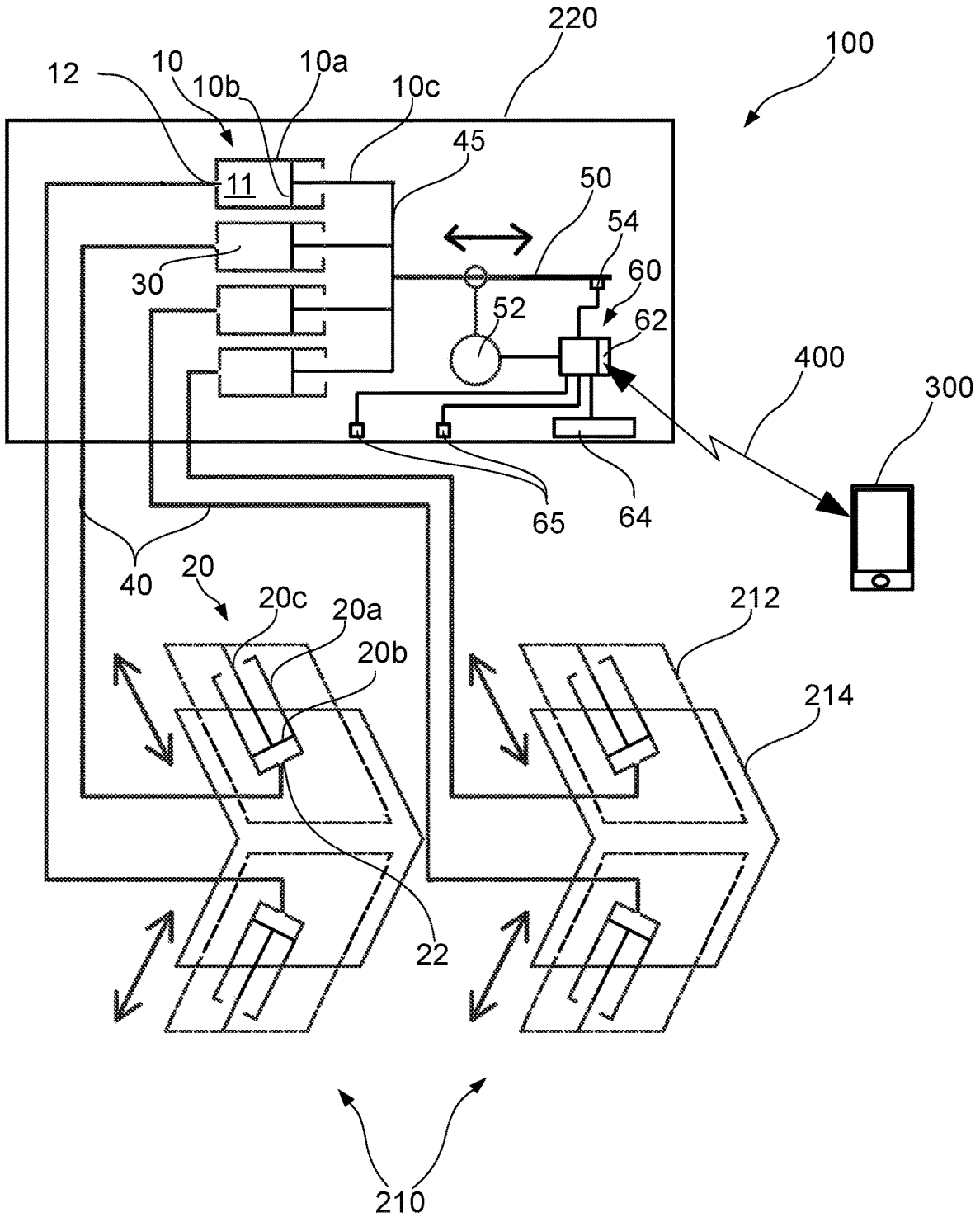

| | | | | |
|---|---|---|---|---|
| 11,497,304 | B1 * | 11/2022 | Pan | A47B 9/20 |
| 2020/0154881 | A1 * | 5/2020 | Applegate | A47B 3/0815 |
| 2022/0087410 | A1 * | 3/2022 | Stiefelmaier | A47B 9/10 |

* cited by examiner

ACTUATOR SYSTEM AND MULTIFUNCTIONAL TABLE COMPRISING SUCH AN ACTUATOR SYSTEM

CROSS-REFERENCE TO RELATED APPLICATION

This application is a U.S. National Stage of PCT/HU2020/050037, filed Aug. 6, 2020, which claims priority to Hungarian Application No. P1900293, filed Aug. 15, 2019, each of which is incorporated herein by reference.

The present invention relates to an actuator system for a table with at least two table legs of variable length and a table top held by the table legs.

The invention further relates to a multifunctional table having at least two table legs of variable length and a table top held by the table legs and comprising an actuator system according to the invention.

Tables are used in many different environments for different purposes. The tables are mostly used by seated persons and can serve as a room divider, workstation or dining table, for example. However, tables are used not only for sitting activities, but also for standing receptions or standing people, for example. Where tables are used for multiple purposes, ideally the tables are designed so that their height should be ergonomically appropriate for the purpose. For example, the height of a typical table top designed for a seated user is approx. 70-76 cm, while for tables designed for standing purposes, this value is approx. 100-115 cm. In order to avoid having to use different tables for tasks requiring different table heights, height-adjustable tables have been created, the height of which can be adjusted according to the way it is used. Most height-adjustable tables in the prior art have telescopic legs that have some kind of counterweight mechanism. The simplest such mechanisms include springs, such as those disclosed in U.S. Pat. No. 3,140,559 or 4,981,085. In U.S. Pat. No. 4,559,879, the height of the table is adjusted by means of pulleys and cables, but there are also solutions using air springs arranged in the table legs. The disadvantage of the solutions presented above is that the user has to move the table himself, which can be especially problematic with a higher weight packed on the table. Although counterbalanced mechanics provide a solution to this problem, they either increase the weight of the table or are expensive due to their complex design. The other disadvantage is that when moving manually, the previous height settings are lost, i.e. the user has to set the desired heights again and again.

The above disadvantages are partially eliminated by the solutions in which the movement is done by electric motors. Such an electrically adjustable height table is also described, for example, in U.S. Pat. No. 6,546,880, the essence of which is that in both legs of the table there is a complex moving mechanism comprising gears and a chain, which are driven by an electric motor through a shaft. The advantage of electric movement is that the user can comfortably adjust the height even when more weight is placed on the table. However, the disadvantage is that the even movement of the table legs can be ensured only with the help of complicated mechanics or electronic motion control devices, and the storage of the already set heights is not solved here either.

There is a need for actuator system that can easily and reliably adjust the height of the table legs without complicated mechanics and electronic motion control devices, i.e. that ensures that the displacements and movement speeds of the table legs are the same during height adjustment.

It has been found that using at least two master cylinders operated by a drive unit and mechanically connected to each other, and using slave cylinders connected to the master cylinders by means of conduits ensuring fluid flow, the simultaneous and continuous adjustment of the table legs can be provided easier and in a more efficient way compared to the known solutions.

It has also been found that using a central IT unit which is electronically connected to the drive unit and which is capable of controlling the drive unit, the user-set table height values can be stored and thus easily restore them as required.

It has also been found that if the central IT unit is provided with a communication module for establishing a wireless data connection, preferably a Bluetooth connection, with an external device and if the central IT unit is configured to be controlled via the wireless data connection, a table can be created whose height can be adjusted remotely using an external device (such as a smartphone).

The objects of the invention are to provide an actuator system and a multifunctional table comprising such an actuator system, which are free from the disadvantages of the prior art solutions, i.e. by means of which the table legs can be adjusted simultaneously without the use of complicated mechanics and motion control electronics.

These objects are achieved by an actuator system according to claim 1.

These objects are further achieved by a multifunctional table according to claim 13.

Further advantageous embodiments of the invention are defined in the attached dependent claims.

Further details of the invention will be explained by way of exemplary embodiments with reference to the figures.

FIG. 1*a* is a schematic view of an exemplary embodiment of an actuator system according to the invention in a first position.

Figure 1B:
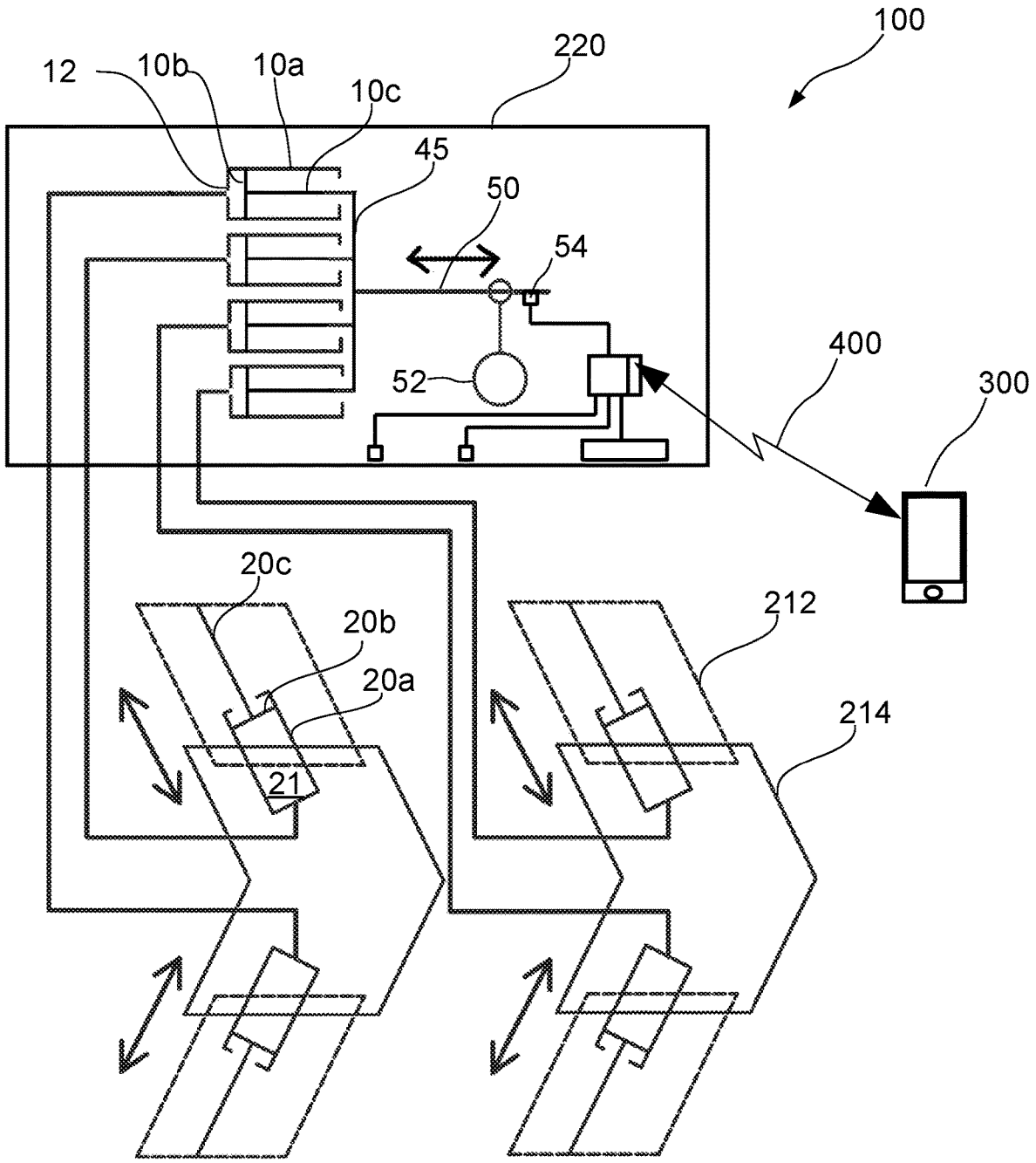

FIG. 1*b* is a schematic view of the actuator system shown in FIG. 1*a* in a second position.

Figure 2:
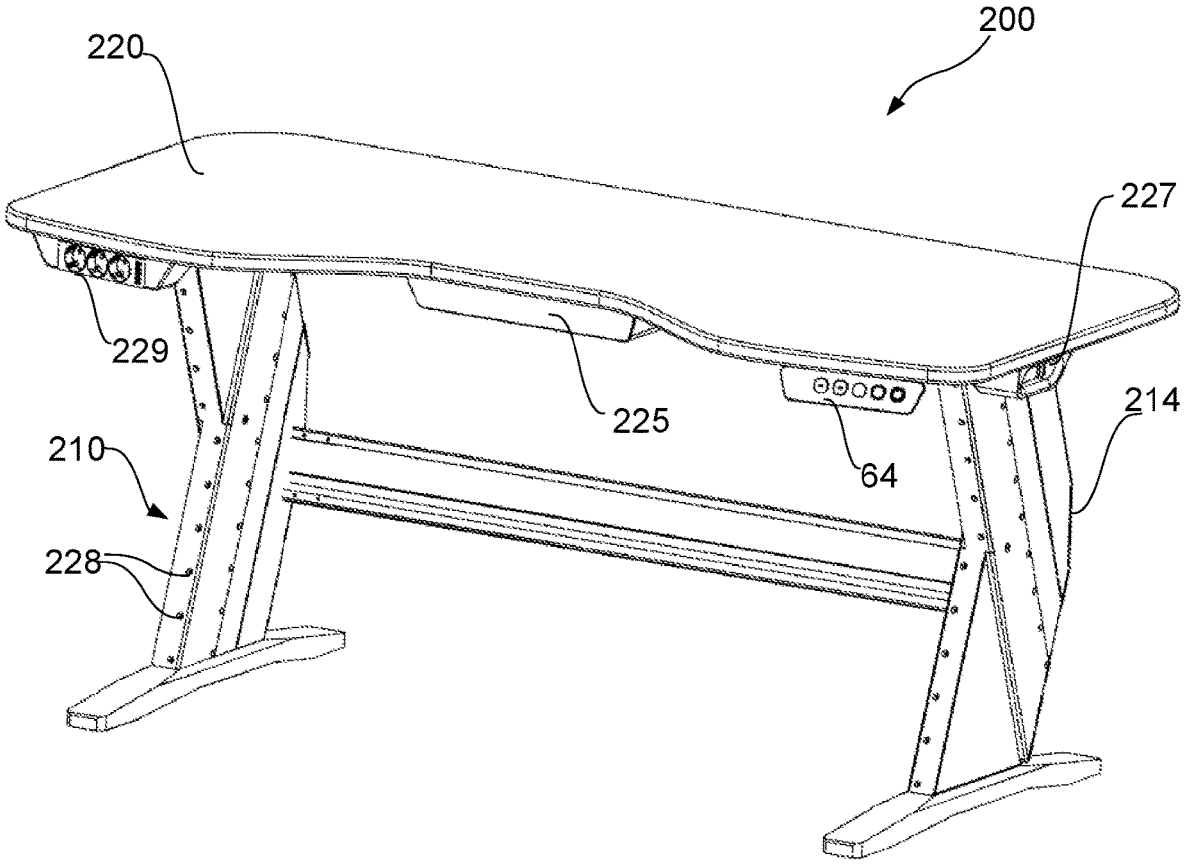

FIG. 2 is a schematic view of an exemplary embodiment of a multifunctional table according to the invention.

Figures 3A, 3B:
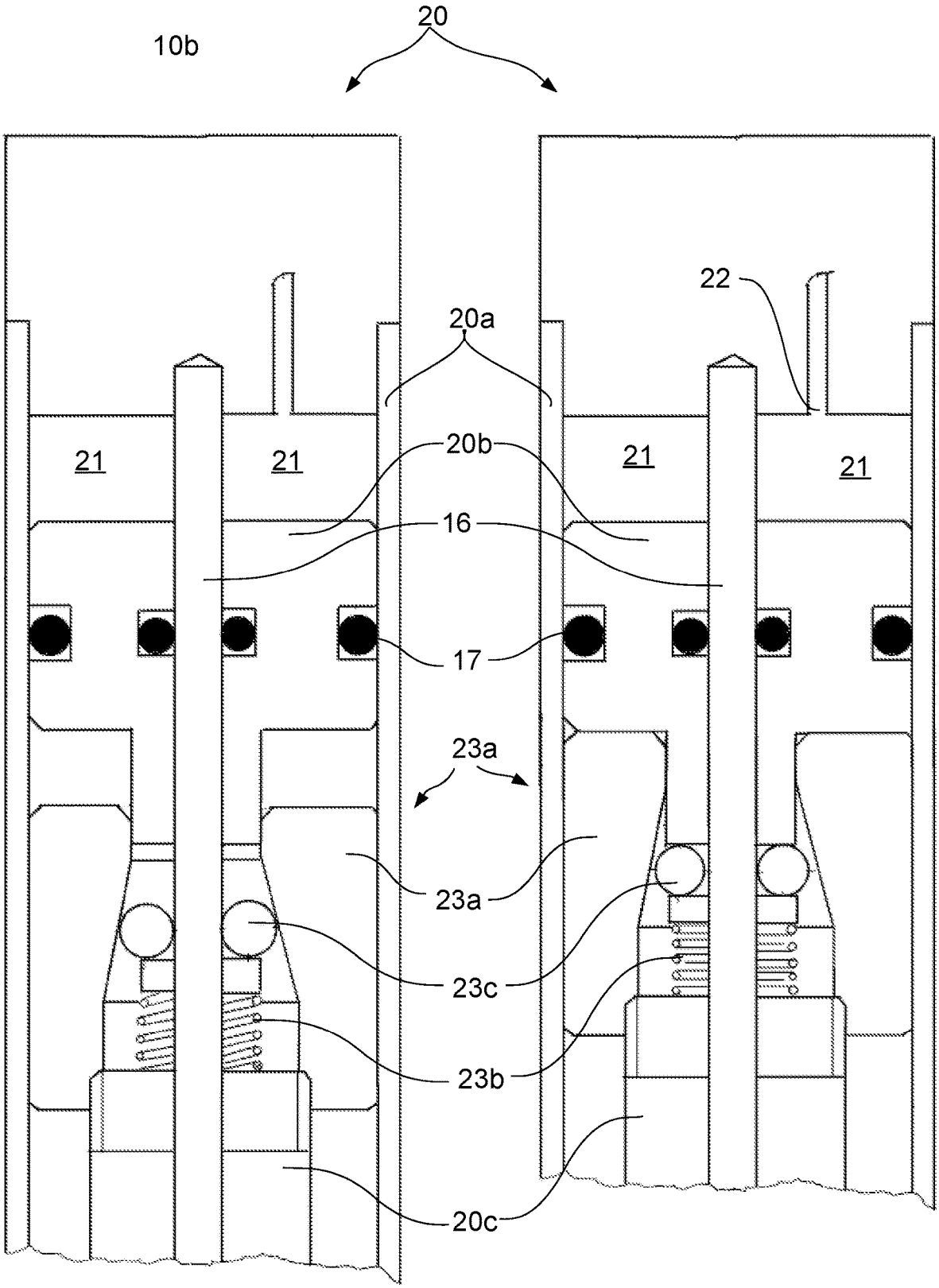

FIG. 3*a* is a schematic side sectional view of an exemplary embodiment of a locking element according to the invention in a first position of the locking element.

FIG. 3*b* is a schematic side sectional view of the locking element shown in FIG. 3*a* in a second position of the locking element.

Figure 4:
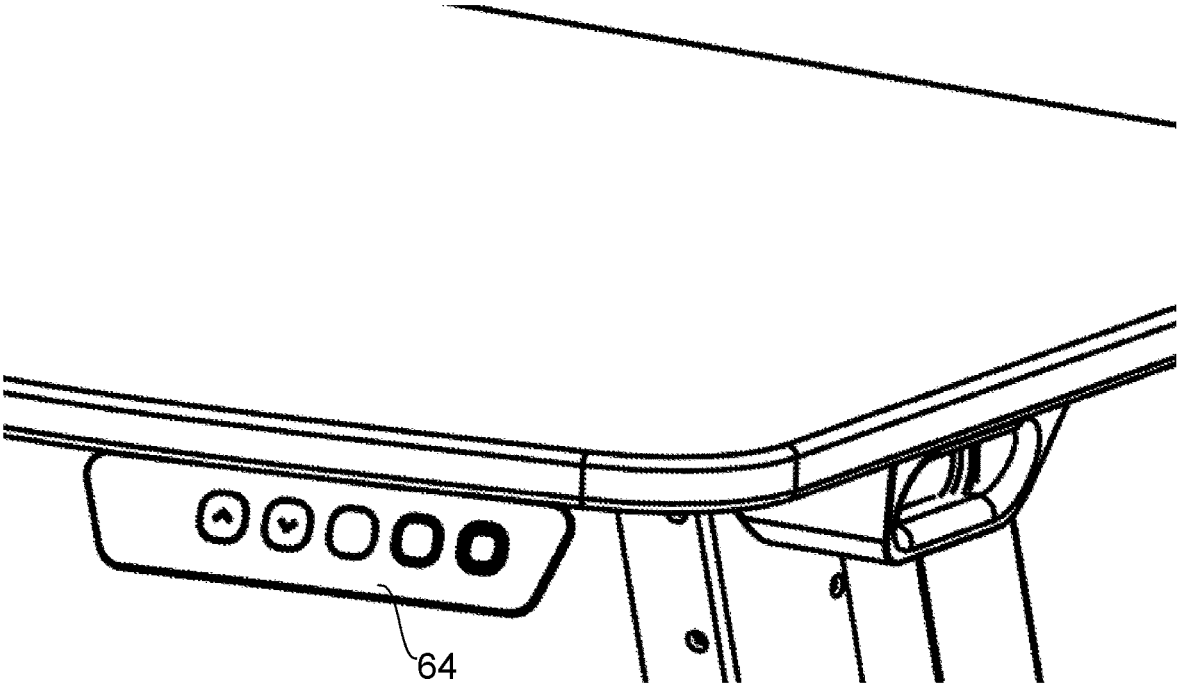

FIG. 4 is a schematic view illustrating an exemplary embodiment of a user interface according to the invention.

Figure 5A:
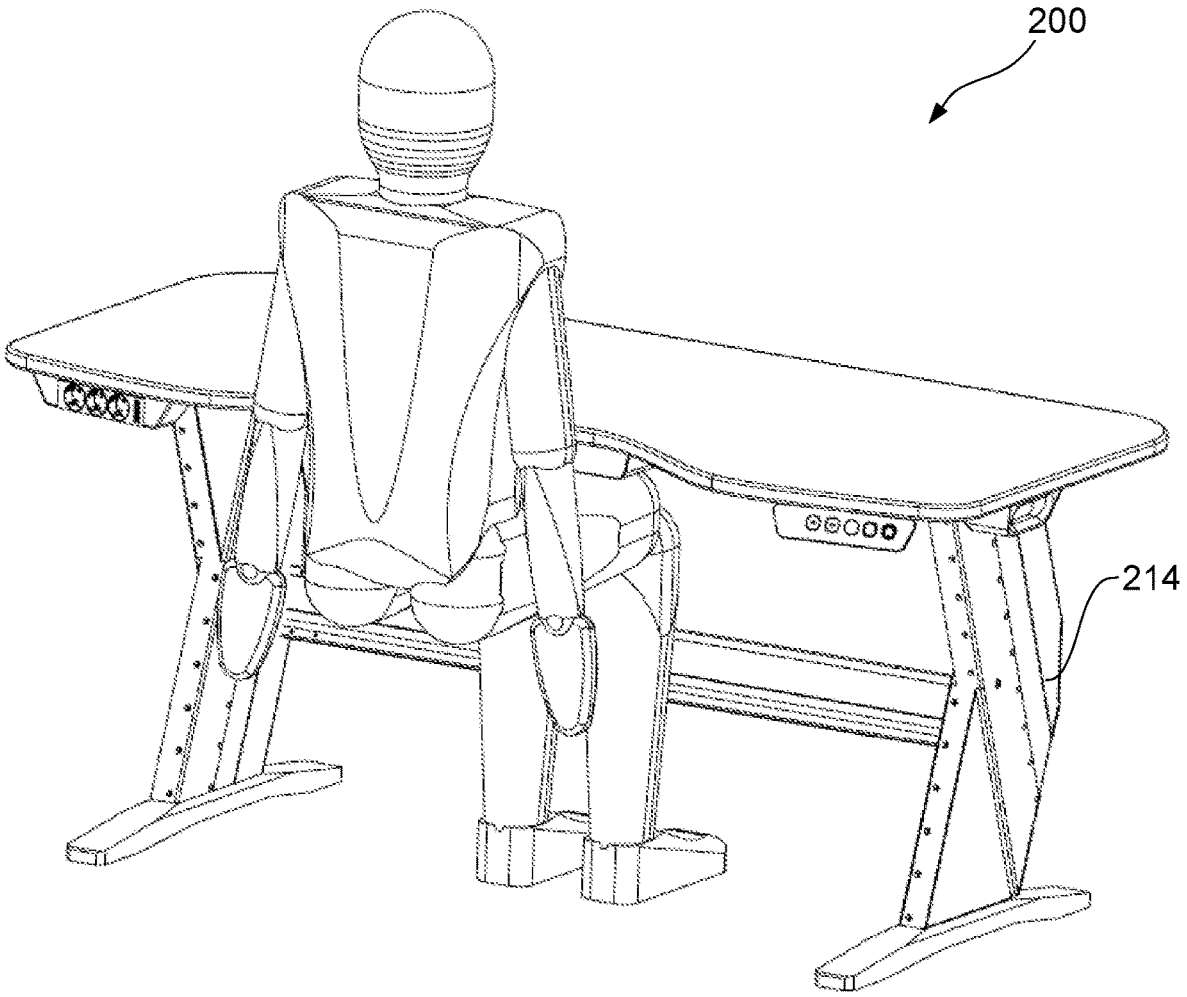

FIG. 5*a* is a schematic view showing a multifunctional table according to the invention in a first position.

Figure 5B:
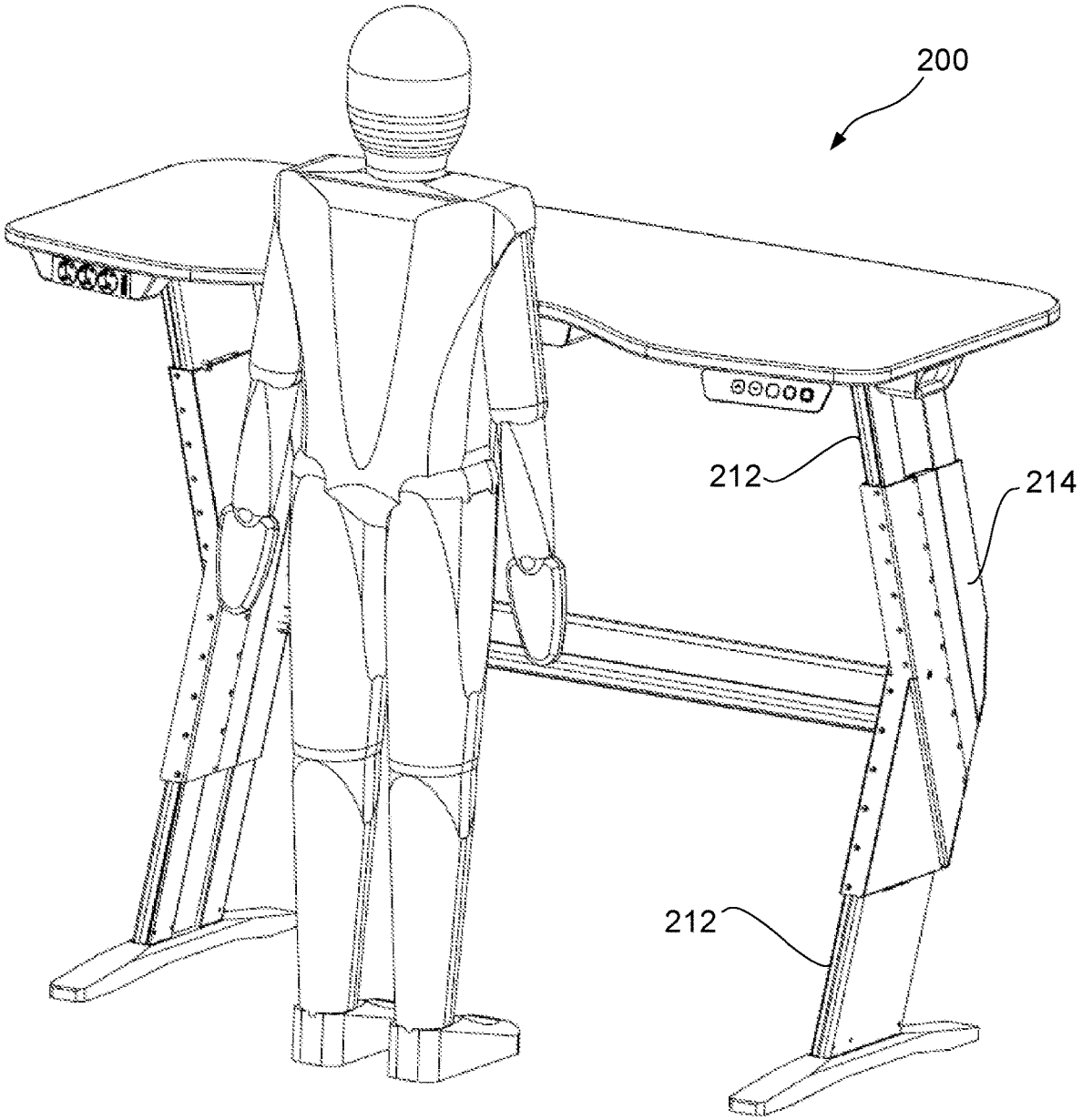

FIG. 5*b* is a schematic view of a multifunctional table according to the invention in a second position.

Figure 6:
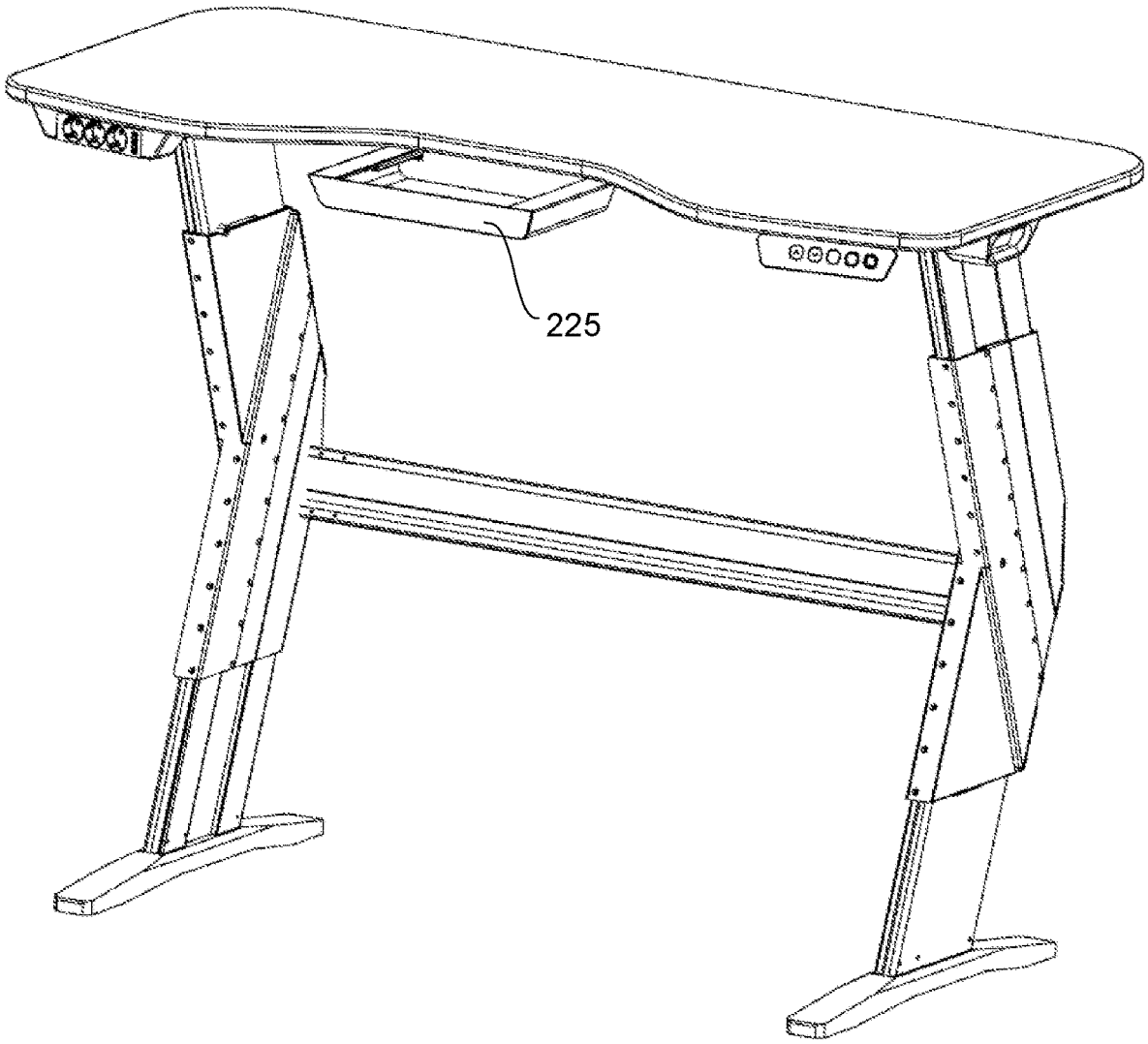

FIG. 6 is a schematic view showing an exemplary embodiment of a pull-out drawer built into a table top according to the present invention.

Figure 7A:
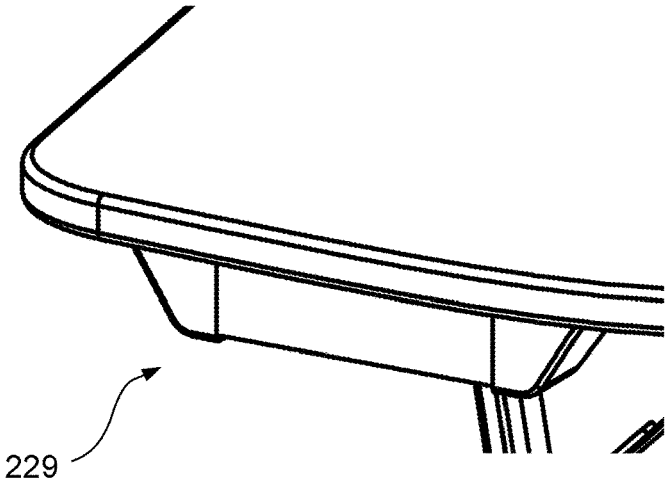
Figure 7B:
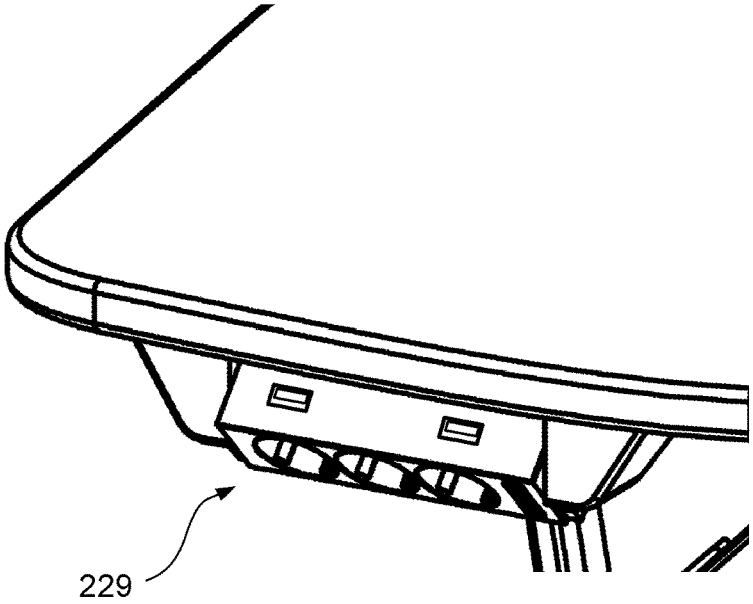
Figure 7C:
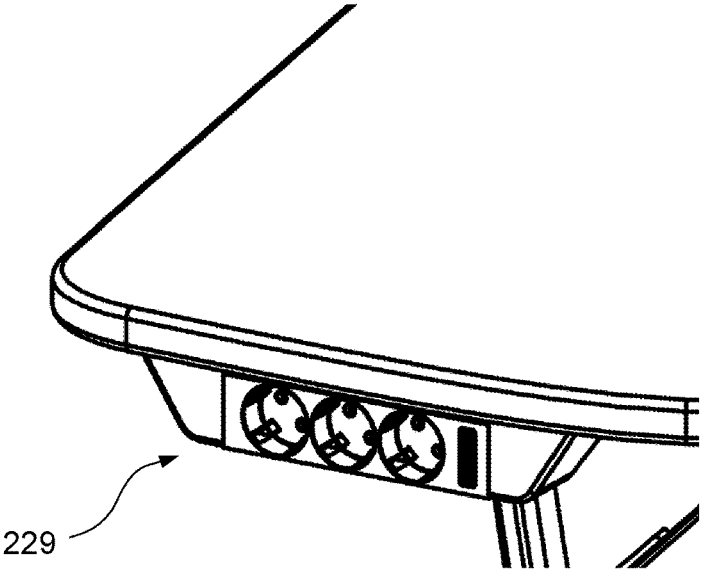
Figure 8A:
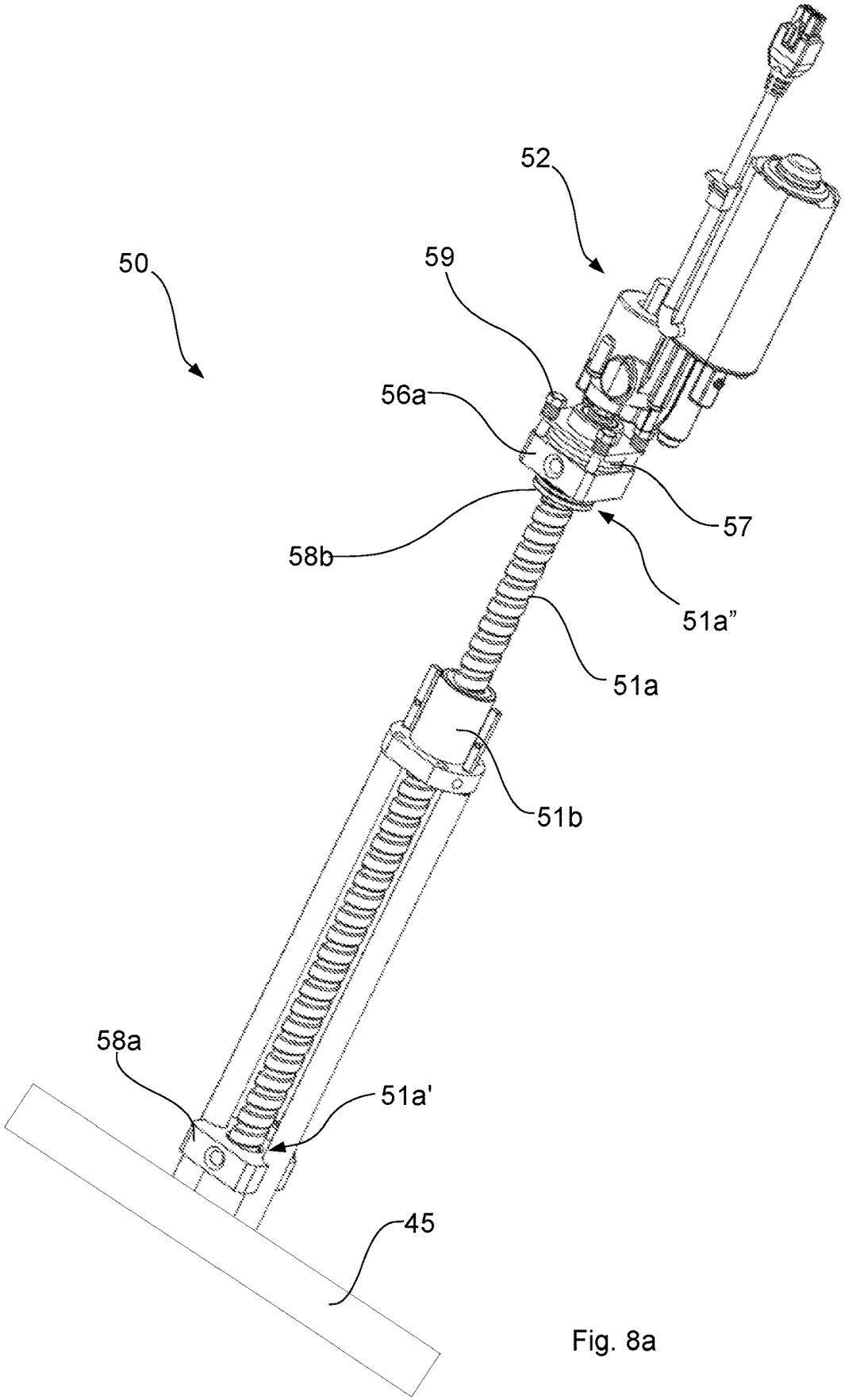
Figure 8B:
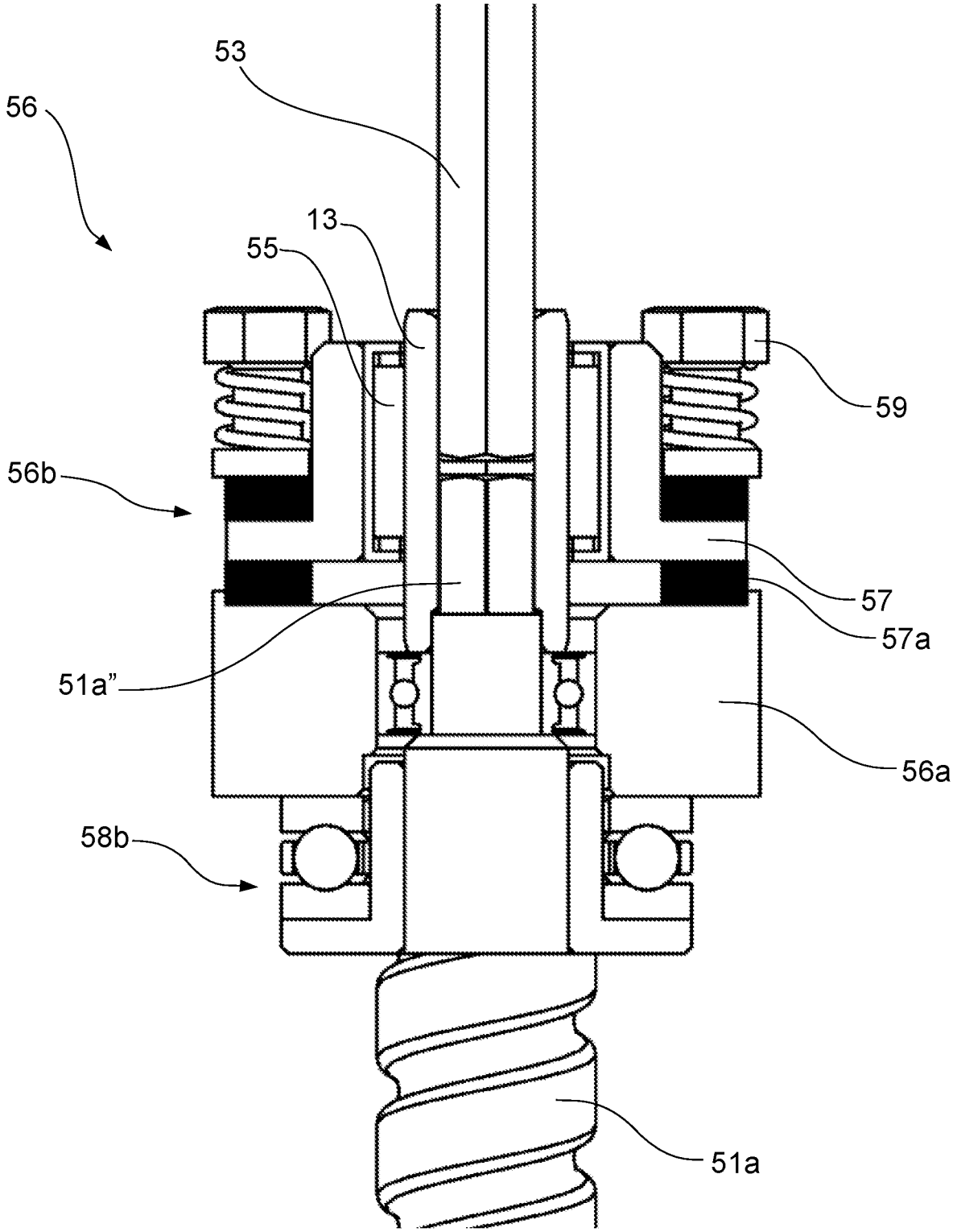

FIG. 7*a* is a schematic view of a first socket-hiding position of a tiltable socket board according to the invention, FIG. 7*b* is a schematic view showing a second position of a tiltable socket board according to the invention, revealing USB charging sockets, FIG. 7*c* is a schematic view showing a third position of a tiltable socket board according to the invention, revealing mains sockets, FIG. 8*a* is a schematic view of an exemplary embodiment of an actuator system according to the invention, a FIG. 8*b* is a schematic sectional view of a clutch shown in FIG. 8*a*.

FIGS. 1*a* and 1*b* show a schematic view of the main components of an exemplary embodiment of an actuator system 100 according to the invention. The system 100 is for adjusting the height of a table 200 having at least two table legs 210 of variable length and a table top 220 supported by the table legs 210, an exemplary embodiment of which table 200 is shown in FIG. 2. Note that the height of the table 200 is the height of the table top 220 relative to the ground. A table leg 210 of variable length can be created, for example, by the hollow center member 214 shown in FIGS. 1*a* and 1*b* and by movable element 212 capable of moving up and down telescopically therein, one of which movable elements 212 is in contact with the ground and the other movable element 212 is in contact with the table top 220. The material of the movable elements 212 and the center member 214 can be, for example, plywood, which can be made with different material qualities and patterns (e.g. oak, birch, beech, etc.). The telescopic guide can be provided, for example, by anodized aluminum and/or plastic sliders, as will be apparent to those skilled in the art. Of course, embodiments are also conceivable in which the table legs 210 comprise only one movable element 212, or in which the table legs 210 are not telescopic but have, for example, scissor lifting mechanisms (not shown), as is known to those skilled in the art. In a possible embodiment, in order to increase the stability of the table 200, a brace is formed between the table legs 210, on which a footrest can optionally be mounted.

The system 100 according to the invention comprises at least two master cylinders 10 having a cylinder 10*a* and a piston 10*b* movable in the cylinder 10*a* and a piston rod 10*c* for moving the piston 10*b*. In the context of the present invention, the master cylinder 10 is an energy conversion device that converts the linear kinetic energy of the piston 10*b* into the compressive energy of a fluid 30 pressed from the cylinder 10*b* by the piston 10*b*, as is known to those skilled in the art. The fluid 30 may be, for example, compressed air (i.e., gaseous) or hydraulic oil (or other fluid). The fluid 30 is in a cylinder space 11 defined by the inner surface of the cylinder 10*a* and the side of the piston 10*b* opposite the piston rod 10*c*. Preferably, there is a seal and a slip ring between the piston 10*b* and the cylinder 10*a*, as will be apparent to those skilled in the art. The cylinder space 11 is provided with an opening 12 of a diameter smaller than that of the cylinder 10*a*, which allows the fluid 30 to flow in and out of the master cylinder 10.

A slave cylinder 20 having a cylinder 20*a* and a piston 20*b* movable in the cylinder 20*a* for changing the length of the table leg 210 is connected to each of the master cylinders 10 by means of a conduit 40 allowing fluid 30 flow between the master cylinder 10 and the slave cylinder 20. The slave cylinder 20 has a piston rod 20*c* which is similar to or identical to the master cylinder 10 and which is optionally attached to the piston 20*b*. In a preferred embodiment, in which the fluid 30 is a liquid, the piston rod 20*c* is indirectly connected to the piston 20*b* by means of a locking element 23, i.e. the piston rod 20*c* is not fixedly attached to the piston 20*b*. The locking element 23 is fixed to the piston rod 20*c*, for example by welding or screwing, but optionally parts of the piston rod 20*c* and the locking element 23 can also be formed as a single element. The locking element 23 is formed as to prevent the piston rod 20*c* from being removed from the piston 20*b* and to allow it to be moved towards the piston 20*b*. An exemplary embodiment of the locking element 23 is shown in FIGS. 3*a* and 3*b*. In this case, the piston 20*b* and the piston rod 20*c* are provided with a bore through which bores a rod 16 fixed to the top of the cylinder 20*a* is passed so that the piston 20*b* and the piston rod 20*c* can be displaced along the longitudinal axis of the rod 16. A seal 17 is arranged between the rod 16 and the bore to prevent fluid 30 from leaking through the bore. The piston rod 20*c* is connected to the piston 20*b* via the locking element 23. The locking element 23 comprises a locking sleeve 23*a* and a spring 23*b* fixed to the piston rod 20*c*, and one or more balls 23*c* movable by the spring 23*b*. The ball 23*c* may optionally be fixed to the end of the spring 23*b*. In the basic position shown in FIG. 3*a*, the locking sleeve 23*a* with a conical (inclined) inner surface is in contact with the piston 20*b*, i.e. the force exerted by the piston 20*b* is transmitted by the locking sleeve 23*a* to the piston rod 20*c*. The spring 23*b* is then compressed and presses the one or more balls 23*c* to the bottom of the piston 20*b*. In this case, the one or more balls 23*c* do not come into contact with the inner conical surface of the locking sleeve 23*a*. When the piston rod 20*c* is subjected to a pulling force, the piston 20*b* remains in place due to atmospheric pressure, and the locking element 23 begins to move away from the piston 20*b*. The spring 23*b* raises the one or more balls 23*c* relative to the piston rod 20*c* (see FIG. 3*b*). The distance between the ball 23*c* and the inner conical wall of the locking sleeve 23*a* begins to decrease until the ball 23*c* comes into contact with both the rod 16 and the locking sleeve 23*a*. If the inner conical circumferential surface of the locking sleeve 23*a* is at such an angle that a frictional force due to the normal direction of the compressive force and the coefficient of friction between the parts can be generated at the point of contact with the ball 23*c*, i.e. the ball 23*c* can no longer roll, then the ball 23*c* is tensioned between the locking sleeve 23*a* and the rod 16, i.e. it locks the rod 16 and the locking sleeve 23*a* by the applied frictional forces, so that they cannot move relative to each other. That is, the piston rod 20*c* in rigid connection with the locking sleeve 23*a* cannot be further removed from the piston 20*b*. When the piston rod 20*c* and the locking sleeve 23*a* are subjected to a compressive force towards the piston 20*b*, the distance between the inner wall of the locking sleeve 23*a* and the ball 23*c* begins to increase, thereby releasing the locking between the ball 23*c* and the rod 16 and the locking sleeve 23*a*. That is, in the state of the locking sleeve 23*a* in contact with the piston 20*b* (FIG. 3*a*), the piston 20*b* and the piston rod 20*c* can be moved together within the cylinder 20*a*. It should be noted that, if necessary, other locking solutions than those described above are conceivable, as is known to the person skilled in the art.

The inner surface of the cylinder 20*a* and the piston 20*b* define a cylinder space 21 filled with fluid 30. The cylinder space 21 is provided with an opening 22 having a diameter smaller than that of the cylinder 20*a* to allow the fluid 30 to flow in and out of the master cylinder 20. In the context of the present invention, the connection of the master cylinder 10 and the slave cylinder 20 means that a fluid flow is provided between the cylinder spaces 11, 21 by means of the conduit 40 by connecting the ends of the conduit 40 to the openings 12, 22. In this way, the fluid 30 can flow from one cylinder space 11, 21 to the other cylinder space 21, 11 as a result of the displacement of the piston 10*b*. In a preferred embodiment, the master cylinders 10 and the slave cylinders 20 are hydraulic cylinders, preferably single-acting hydraulic cylinders. In this case, the fluid 30 is in a liquid state, such as hydraulic oil, and the fluid 30 is present only on one side of the pistons 10*b*, 20*b*. The conduit 40 may be a rigid or, optionally, flexible wall conduit suitable for conveying fluid 30.

The piston rods 10*c* of the master cylinders 10 according to the invention are mechanically connected to each other by means of a rigid connecting element 45, such as a metal rod, so that the pistons 10*b* can only be moved together and only simultaneously within the cylinders 10*a*. The master cylinders 10 are preferably arranged directly next to each other, for example as shown in FIGS. 1*a*, 1*b*. A drive unit 52 is connected to the connecting element 45 for simultaneous movement of the pistons 10*b* of the master cylinders 10, wherein the drive unit 52 is in a rigid drive connection 50 with the connecting element 45. In the present description, the rigidity of the drive connection 50 means that the connecting element 45 can only move together with the drive connection 50, i.e. by fixing the drive connection 50, the position of the connecting element 45 is also fixed. In an exemplary embodiment, the drive connection 50 is implemented by means of a spindle drive, and the drive unit 52 is designed as an electric motor, preferably a DC motor. In this embodiment, a rigid rod with an external thread is attached to the connecting member 45, and the drive unit 52 in the form of an electric motor comprises an internally threaded, externally toothed gear through which the rod is passed. By rotating the gear in the appropriate direction, the rod passed through it can be moved in the desired direction.

In a particularly preferred embodiment shown in FIG. 8*a*, the drive connection 50 is a spindle drive. In this embodiment, the connecting member 45 is indirectly fixed to the ball nut 51*b* of the ball screw 51*a*, wherein a first end 51' of the ball screw 51*a* being fixed to allow rotation about the axis of the ball screw 51*a*, for example by means of a rolling bearing 58*a* known to a person skilled in the art. The bearing 58 may be secured to the table top 220. A second end 51*a*" of the ball screw 51*a* is connected to the drive unit 52 via a clutch 56. In FIG. 8*b*, it can be seen that the clutch 56 has a fixed stationary part 56*a* (which is attached to the table top 220, for example) and a movable part 56*b* connected to the second end 51*a*" and the drive unit 52 for rotation about the axis of the ball screw 51*a* relative to the stationary part 56*a*. In this embodiment, the second end 51*a*" of the ball screw 51*a* rests on the stationary part 56*a* via an axial rolling bearing 58*b*, and a sleeve 13 is connected to the second end 51*a*" in a form-locking manner. A drive shaft 53 of the drive unit 52 is also form-locked to the sleeve 13. That is, in this embodiment, the second end 51*a*" is secured to the drive shaft 53 by the sleeve 13. It is noted that, if necessary, the fastening can be done in other ways, for example by means of ribbed shaft connection, latching or other form-locking design, or the second end 51*a*" can even be fastened directly to the drive shaft 53, for example by welding.

The movable part 56*b* is connected to the second end 51*a*" via a freewheel 55 which closes when the ball screw 51*a* rotates in one axial direction and which opens when the ball screw 51*a* rotates about the other axial direction. The freewheel 55 is configured to break the torque connection between the second end 51*a*" and the movable part 56*b*" in the direction of rotation of the ball screw 51*a* required to raise the table top 220. In this case the second end 51*a*" can rotate freely without transmitting torque to the movable part 56*b*. On the other hand, in the direction of rotation required to lower the table top 220, the freewheel 55 closes, i.e. a torque connection is provided between the second end 51*a*" and the movable part 56*b*.

There is a frictional connection between the movable part 56*b* and the stationary part 56*a*, i.e. the movable part 56*b* can only be rotated at a non-negligible torque with respect to the stationary part 56*a* due to the frictional forces between the stationary part 56*a* and the movable part 56*b*. The frictional connection is preferably provided by means of a brake disc 57 fixed to the freewheel 55 and pressed against the stationary part 56*a*. On each side of the brake disc 57 there are friction elements 57*a* preferably made of plastic. In a particularly preferred embodiment, the clutch 56 comprises clamping bolts 59, preferably spring clamping bolts 59, screwed into the stationary part 56*a*, pressing the brake disc 57 to the stationary part 56*a*, by means of which the strength of the frictional connection between the stationary part 56*a* and the movable part 56*b* can be adjusted to the desired value.

The frictional forces provided by the friction elements 57*a* generate a frictional torque when the brake disc 57 begins to rotate as the stationary part 56*a* is stationary. In the case where the ball screw 51*a* rotates in a certain direction, i.e. the table top 220 rises, the brake disc 57 remains stationary because the freewheel 55 opens in this direction of rotation, i.e. the sleeve 13 formed in its bore can rotate freely with negligible rolling resistance. When the drive unit 52 is turned off, so that the table top 220 does not rise further, the ball screw 51*a* would start to rotate backward due to the constant gravitational force acting on the table top 220. At this direction of rotation, the freewheel 55 closes, i.e. a drive is formed. The friction elements 57*a* generate a determinable and adjustable frictional torque on the brake disk 57, thereby braking the ball screw 51*a*. The resulting frictional torque can be controlled and adjusted by tightening the clamping bolts 59 to the appropriate torque, selecting the material of the friction elements 57*a*, and selecting the working diameter of the brake disc 57. When it is necessary to lower the table top 220, the drive unit 52 rotates the ball screw 51*a* through the drive shaft 53. At this direction of rotation, the brake disc 57 also rotates, and the power of the drive unit 52 is required to move it, however this power is only a fraction of the power required to lift the table 200. This solution ensures that the ball screw 51*a* operates with high efficiency in the lifting direction, while the system is self-locking.

In another exemplary embodiment, the drive connection 50 is formed by a rack and the drive unit 52 rotates a gear which fits into the teeth of the rack (not shown in the figures). In addition to the above, of course, other known rigid drives are possible, as is apparent to those skilled in the art.

In a preferred embodiment, the drive unit 52 is provided with a transmitter 54 configured to determine the position of the pistons 10*b* of the master cylinders 10 within the cylinders 10*a*. The transmitter 54 may be any sensor known to those skilled in the art (e.g., laser, magnetic, inductive, potentiometer, etc.) that is capable of directly or indirectly determining the position of the rigid system formed by the pistons 10*b*, piston rods 10*c*, and connecting element 45. In one possible embodiment, the transmitter 54 is configured as an optical odometer, preferably arranged on the drive connection 50. An optical odometer is a device for constructing an optical, non-contact, incremental or, preferably, absolute measuring system comprising a plurality of scales with transparent and opaque divisions and a reading head, such as a photoelectric sensor, for detecting and processing the information on the scale.

In a particularly preferred embodiment, the system 100 includes a central IT unit 60 electronically connected to the drive unit 52 for controlling the drive unit 52, and which is preferably arranged in the table top 220. The central IT unit 60 is configured to operate the drive unit 52. The term central IT unit 60 is broadly understood herein to include all hardware devices suitable for data collection, processing, and control of the drive unit 52, such as a computer, SoC (System on a Chip), microcontroller, and the like. In a particularly preferred embodiment, the central IT unit 60 stores a plurality of control programs for setting the position of the connecting member 45, and thereby the position of the pistons 10*b*, and the central IT unit 60 is configured to execute the stored one or more control programs. In the context of the present invention, a control program is a sequence of instructions written in any programming language and executable by the central IT unit 60 and stored as a bit set, which determines the position of the pistons 10*b* within the cylinders 10*a*. That is, different control programs define different 45 connector positions.

In a preferred embodiment, the central IT unit 60 includes a communication module 62 for making a wireless data connection 400, preferably a Bluetooth connection, to an external device 300, and the central IT unit 60 is configured to be controlled via the wireless data connection 400. Note that in addition to Bluetooth, other wireless technologies, e.g. ZigBee, WIFI is also applicable, as is obvious to a person skilled in the art. The central IT unit 60 can be connected to a local or global network (e.g., the Internet) via the data connection 400, and the data received and processed by the central IT unit 60 can be retrieved remotely from the central IT unit 60 via the network, or the central IT unit 60 can be remotely controlled by the external device 300 (e.g., a smartphone or tablet) via the network. In this case, the operation of the drive unit 52, i.e. the position of the pistons 20*b* and 10*b*—indirectly connected by means of the conduit 40—(thus ultimately the dimensions of the table legs 210) can be controlled manually (e.g. by using a smartphone) or the control programs can be selected using the smartphone.

In a preferred embodiment, the system 100 includes a user interface 64 electronically connected to the central IT unit 60, as shown, for example, in FIG. 4. The user interface 64 is preferably a row of buttons arranged in the side plane of the table top 220, by means of which the operation of the drive unit 52 can be manually controlled or selected by which control program the central IT unit 60 is to execute. The user interface 64 allows the user to manually adjust the height of the table 200.

The invention further relates to a multifunctional table 200 having at least two table legs 210 of variable length and a table top 220 held by the table legs 210, the table 200 comprising an actuator system 100 according to the invention. In the following, together with the description of the table 200, the operation of the system 100 will be described.

FIGS. 5*a* and 5*b* show the end positions of the multifunctional table 200 according to the invention defining different heights, to which the different states of the system 100—shown in FIGS. 1*a* and 1*b*—belong, respectively. FIG. 5*a* shows the optimal position of the table 200 for the sitting position and FIG. 4*b* shows the optimal position of the table 200 for the standing position. Note that any heights may be set between the end positions shown in FIGS. 5*a* and 5*b*. The height of the table 200 can be infinitely adjusted between the end positions by means of the system 100 according to the invention, for example in the following manner.

By means of the user interface 64 or the external device 300, the drive unit 52 is actuated, during which the connecting element 45 and the pistons 10*b* therewith are moved—depending on the direction of height adjustment—in the corresponding direction via the first drive connection 50. The drive unit 52 may be operated manually, for example, by pressing the appropriate buttons on the user interface 64 or the external device 300, or automatically by selecting a control program. For example, if the height of the table top 220 is to be increased, the cylinder spaces 11 of the master cylinders 10 are reduced by moving forward the connecting element 45, the piston rods 10*c* and the pistons 10*b*, thereby the fluid 30 in the cylinder spaces 11 flows into the cylinder spaces 21 of the slave cylinders 20 through the conduits 40 due to the increased pressure. Hence, the volume of the cylinder spaces 11 decreases, the volume of the cylinder spaces 21 increases (see FIGS. 1*a* and 1*b*). The fluid 30 flowing into the cylinder spaces 21 exerts a pressure on the pistons 20*b*, which causes the pistons 20*b* to move. With the pressure of the fluid, the compressive force on the other side of the pistons 20*b* is balanced. This compressive force is provided by the weight of the table 200 and the objects placed on it. As a result, the compressive force exerted by the drive unit 52 on the pistons 10*b* is transmitted to the pistons 20*b* and to the movable element 212 connected to the pistons 20*b* via the fluid 30. The relative distance between the movable element 212 and the center member 214 fixed to the cylinder 20, i.e. the length of the table leg 210, is thereby increased. After the table top 220 has been raised to the desired height, the position of the pistons 10*b* within the cylinders 10*a* is fixed by the drive unit 52 and the rigid drive connection 50. Thereby, the fluid 30 is prevented from flowing back from the cylinder spaces 21 into the cylinder spaces 11. If it is desired to reduce the height of the table 200, it is ensured that the fluid 30 can flow from the cylinder spaces 21 to the cylinder spaces 11. By means of the drive unit 52, the pistons 10*b* are moved so as to increase the volume of the cylinder spaces 11. Thereby, the compressive force (gravity) on the other side of the pistons 20*b* compresses the fluid 30 in the cylinder space 21 into the cylinder spaces 11 through the conduits 40, while reducing the relative distance between the center member 214 and the movable element 212 fixed to the slave cylinder 20, i.e. the length of the table leg 210 decreases. It is noted that the slave cylinders 20 are preferably arranged in the table legs 210 and the master cylinders 10 and the drive unit 52 are preferably located in the table top 220, but other embodiments may be possible as will be apparent to those skilled in the art.

When the table 200 is lifted or transported, the pistons 20*b* are subjected to a pulling force due to the weight of the movable elements 212 and the center members 214, which tends to increase the volume of the cylinder spaces 21. If the fluid 30 is a liquid, the pressure in the cylinder space 21 decreases and a vacuum is created. In this case, the atmospheric pressure on the outer surface of the piston 20*b* will be higher than the vacuum in the cylinder space 21, so that the atmospheric pressure will create an inward compressive force, which is opposite to the tensile force. Due to the small diameter of the pistons 20*a* and therefore their small effective surface, the force generated by the atmospheric pressure is always overcome by the tensile force, i.e. even with a small tensile force the pistons 20*b* move, thus increasing the length of the cylinder 20. In practice, due to the above, when the table top 220 is lifted, the length of the table legs 210 increases as long as the structure allows. That is, the table 200 can only be lifted off the ground if the table top 220 is raised to the maximum height defined by the structure, and then the table legs 210 are already raised. This is both inconvenient and dangerous, as raising and lowering the table 200 can cause the table top 220 to fall if it is not lifted from the highest position. In the case of embodiments with locking elements 23, this problem does not arise, since the locking element 23 described above prevents the piston rod 20*c* from being removed from the piston 20*b*, i.e. increasing the length of the cylinders 20 and the table legs 210 by pulling.

In a preferred embodiment, the various user-set positions of the table 200 can be stored in the central IT unit 60 in the form of control programs. In this case, physical or virtual memory buttons are provided on the user interface 64 or the external device 300 to create and call up the particular control program. Thus, the given height setting (similar to memory car seats) can be assigned to the button, for example, by holding down the given memory button and the height can be retrieved automatically by pressing the button once.

In a preferred embodiment, the table 200 includes one or more sensors 65 in data communication with the central IT unit 60. Said one or more sensors 65 are selected from a group consisting of a humidity meter, a carbon dioxide sensor, a temperature gauge and an air pressure gauge. The data measured by the one or more sensors 65 is preferably transmitted to the external device 300 via the communication module 62 of the central IT unit 60 (e.g. via a Bluetooth connection). In this way, based on the measured data, the user is informed (e.g. by a mobile application running on the external device 300) about the current ambient air quality, temperature, etc., or the application may send an alert if e.g. the air quality is low.

In the embodiment shown in FIG. 6, the table 200 of the present invention includes a pull-out drawer 225 built into the table top 220, which drawer 225 is provided with an electronic lock controlled by the central IT unit 60 (not shown in FIGS.). That is, the electronic lock is operated (opened and closed) by means of the central IT unit 60. In a preferred embodiment, the drawer 225 does not include a handle, and the drawer 225 is opened by a mobile application running on the external device 300. For example, after entering a password or ID, the drawer 225 opens automatically. Preferably, the open state of the drawer 225 is continuously indicated by the application in case it has been inadvertently left open. In this embodiment, the drawer 225 slides outwards on rails and is opened to 20-30 mm by a spring, from which it can be pulled out by hand. To close, press fully and the electronic lock will lock.

Preferably, the table 200 further includes one or more built-in speakers 227, preferably a Bluetooth speaker and/or a built-in light source 228, preferably an LED light source. For example, the speakers 227 may be incorporated into the table top 220 and the light sources 228 into the table legs 210, as shown in FIG. 2. The light sources 228 are optionally configured to be controlled by the central IT unit 60, and the brightness (or color) of the light sources 228 is preferably controlled by the external device 300.

Preferably, the table 200 further comprises a preferably tiltable socket board 229 with a mains socket and a USB charging socket built into the table top 220, an exemplary embodiment of which is shown in FIGS. 7*a*-7*c*. By default (FIG. 7*a*), no socket is visible, then the USB charging socket is visible by manually tilting in one direction (FIG. 7*b*) and the mains socket by tilting in the other direction (FIG. 7*c*). In another possible embodiment, the table 200 preferably includes a wireless mobile charger (not shown) built into the table top 220, which allows the battery of suitable mobile devices (e.g., smartphone, tablet) to be charged without connecting a cable. The wireless mobile charger can be, for example, a Qi or Powermat standard charger, as is known to those skilled in the art. It is noted that the table 200 may optionally include other additional means, such as a built-in aromatherapy and fragrance evaporator, to allow room air to be perfumed. The principle of operation of the evaporator may be, for example, ultrasonic, as is known to the person skilled in the art.

Various modifications to the above disclosed embodiments will be apparent to a person skilled in the art without departing from the scope of protection determined by the attached claims.

The invention claimed is:

1. Actuator system (100) for a table (200) having at least two table legs (210) of variable length and a table top (220) held by the table legs (210), the actuator system (100) comprises at least two master cylinders (10), each having a cylinder (10*a*) and a piston (10*b*) movable in the cylinder (10*a*) and a piston rod (10*c*) for moving the piston (10*b*), wherein a slave cylinder (20) having a cylinder (20*a*) and a piston (20*b*) movable in the cylinder (20*a*) for changing the length of the table leg (210) is connected to each of the master cylinders (10) by means of a conduit (40) allowing fluid (30) flow between the master cylinder (10) and the slave cylinder (20), and wherein the piston rods (10*c*) of the master cylinders (10) are mechanically connected to each other by means of a rigid connecting element (45), and wherein a drive unit (52) in a rigid drive connection (50) with the connecting element (45) is connected to the connecting element (45) for simultaneously moving the pistons (10*a*) of the master cylinders (10), characterized in that the connecting element (45) is fastened to a ball nut (51*b*) of a ball screw (51*a*), the first end (51*a*') of the ball screw (51*a*) is fixed to allow the ball screw (51*a*) to rotate about an axis, and the second end (51*a*") of the ball screw (51*a*) is connected to the drive unit (52) via a clutch (56), which clutch (56) comprises a fixed stationary part (56*a*) and a movable part (56*b*) connected to the second end (51*a*") and the drive unit (52) for rotation about the axis of the ball screw (51*a*) relative to the stationary part (56*a*), which movable part (56*b*) is connected to the second end (51*a*") via a freewheel (55) which closes when the ball screw (51*a*) rotates in one axial direction and which opens when the ball screw (51*a*) rotates about the other axial direction, and there is a frictional connection between the movable part (56*b*) and the stationary part (56*a*).

2. The actuator system (100) according to claim 1, characterized in that the fluid (30) is a liquid and each of the slave cylinders (20) comprises a piston rod (20*c*) connected to the piston (20*b*) by means of a locking element (23), which locking element (23) is adapted to prevent the piston rod (20*c*) from being removed from the piston (20*b*) and to allow it to be pushed towards the piston (20*b*).

3. The actuator system (100) according to claim 1, characterized in that the first drive connection (50) is provided as a spindle drive and the drive unit (52) is an electric motor.

4. The actuator system according to claim 3 wherein the electric motor is a DC motor.

5. The actuator system (100) according to claim 1, characterized in that the frictional connection is provided by means of a brake disc (57) fixed to the freewheel (55) and pressed against the stationary part (56*a*).

6. The actuator system (100) according to claim 5, characterized in that the clutch (56) comprises clamping bolts (59) screwed into the stationary part (56*a*) and pressing the brake disc (57) against the stationary part (56*a*).

7. The actuator system according to claim 1, characterized in that the drive unit (52) is provided with a transmitter (54) configured to determine the position of the pistons (10*b*) of the master cylinders (10).

8. The actuator system (100) according to claim 1, characterized in that it comprises a central IT unit (60) which is electronically connected to the drive unit (52) for controlling the drive unit (52).

9. The actuator system (100) according to claim 8, characterized in that a plurality of control programs for determining the position of the connecting element (45) are stored in the central IT unit (60).

10. The actuator system (100) according to claim 8, characterized in that it comprises a user interface (64) electronically connected to the central IT unit (60).

11. The actuator system (100) according to claim 8, characterized in that the central IT unit (60) comprises a communication module (62) for providing a wireless data connection (400) with an external device (300) and the central IT unit (60) is configured to be controlled via the wireless data connection (400).

12. The actuator system according to claim 11 wherein the wireless data connection is a Bluetooth connection.

13. Multifunctional table (200) having at least two table legs (210) of variable length and a table top (220) held by the table legs (210), characterized in that it comprises an actuator system (100) according to claim 8.

14. The multifunctional table (200) according to claim 13, characterized in that it comprises one or more sensors (65) in communication with the central IT unit (60), said one or more sensors (65) are selected from a group consisting of a humidity meter, a carbon dioxide sensor, a temperature gauge and an air pressure gauge.

15. The multifunctional table (200) according to claim 13, characterized in that it comprises a pull-out drawer (225) built into the table top (220), which drawer (225) has an electronic lock controlled by the central IT unit (60).

16. The multifunctional table (200) according to claim 13, characterized in that the slave cylinders (20) are arranged in the table legs (210) and the master cylinders (10) and the drive unit (52) are arranged in the table top (220).

17. The multifunctional table (200) according to claim 13, characterized in that it has a tiltable socket board (229) built into the table top (220) comprising a mains socket and a USB charging socket.

18. The multifunctional table (200) according to claim 13, characterized in that it comprises one or more built-in speakers (227) and a built-in light source (228).

19. The actuator system according to claim 8 wherein the central IT unit is arranged in the table top.

20. The actuator system (100) according to claim 1, characterized in that the master cylinders (10) and the slave cylinders (20) are hydraulic cylinders.

* * * * *